US006940463B2

(12) United States Patent
Ittipiboon et al.

(10) Patent No.: US 6,940,463 B2
(45) Date of Patent: Sep. 6, 2005

(54) ULTRA WIDEBAND ANTENNA

(75) Inventors: Apisak Ittipiboon, Kanata (CA); Aldo Petosa, Nepean (CA); Soulideth Thirakoune, Hull (CA); David Lee, Kanata (CA); Marc Lapierre, Orleans (CA); Yahia Autar, Kingston (CA)

(73) Assignee: Her Majesty the Queen in Right of Canada, as represented by the Minister of Industry, through the Communications Research Centre Canada, Ottawa (CA)

( * ) Notice: Subject to any disclaimer, the term of this patent is extended or adjusted under 35 U.S.C. 154(b) by 193 days.

(21) Appl. No.: 10/625,522

(22) Filed: Jul. 24, 2003

(65) Prior Publication Data

US 2005/0017903 A1 Jan. 27, 2005

(51) Int. Cl.[7] ..... H01Q 1/00
(52) U.S. Cl. ..... 343/729; 343/700 MS
(58) Field of Search ..... 343/729, 700 MS, 343/725, 846, 829, 830

(56) References Cited

U.S. PATENT DOCUMENTS

| | | | | |
|---|---|---|---|---|
| 5,940,036 A | | 8/1999 | Oliver et al. | 343/700 MS |
| 6,147,647 A | | 11/2000 | Tassoudji et al. | 343/700 MS |
| 6,452,565 B1 | * | 9/2002 | Kingsley et al. | 343/700 MS |
| 6,531,991 B2 | * | 3/2003 | Adachi et al. | 343/846 |
| 6,700,539 B2 | * | 3/2004 | Lim | 343/700 MS |

FOREIGN PATENT DOCUMENTS

| | | | |
|---|---|---|---|
| JP | 09331207 A | 12/1997 | H01Q/9/30 |
| JP | 2000286626 A | 10/2000 | H01Q/1/38 |
| WO | WO 02/101879 A1 | 12/2002 | H01Q/13/24 |

OTHER PUBLICATIONS

P.V. Anob and G. Kumar, "Wide Band Modified Triangular Monopole Antennas", Proc. of the 8$^{th}$ Int. Symp. On Microwave and Optical Tech., ISMOT 2001, Montreal , Canada, Jun. 2001, pp. 169–172.

S.M. Shum and K.M. Luk, "Stacked Annular Ring Dielectric Resonator Antenna Excited by Axi–Symmetric Coaxial Probe", IEEE Transactions on Antennas and Propagation, vol. 43, No. 8, Aug. 1995, pp. 889–891.

K.W. Leung, "General Solution of a Monopole Loaded by a Dielectric Hemisphere for Efficient Computation", IEEE Transactions on Antennas and Propagation, vol. 48, No. 8, Aug. 2000, pp. 1267–1268.

Darko Kajfez and Ahmed A. Kishk, "Dielectric Resonator Antenna—Possible Candidate for Adaptive Antenna Arrays", University of Mississippi, USA.

* cited by examiner

*Primary Examiner*—Don Wong
*Assistant Examiner*—Ephrem Alemu
(74) *Attorney, Agent, or Firm*—Teitelbaum & MacLean; Neil Teitelbaum; Doug MacLean

(57) ABSTRACT

An ultra-wideband antenna for operating in a frequency is disclosed wherein a monopole antenna extends from a ground plane. The monopole has an effective length L of one quarter wavelength at the lowest frequency $f_1$. A dielectric resonator antenna (DRA) surrounds the monopole antenna for resonating at substantially between or at two and three times the lowest frequency $f_1$, the DRA is of a height of less than ¾ L and is disposed in such a manner as being above the ground plane and either contacting or spaced therefrom by a gap G, wherein $0 \leqq G \leqq 0.2$ H. The ultra-wideband antenna is of a much greater bandwidth than the sum of bandwidth of the monople or the DRA alone.

9 Claims, 4 Drawing Sheets

(a) vertical plane ····· 8.2 GHz —•··· 4.35 GHz ——— 10.0 GHz (b) azimuth plane ····· 8.2 GHz ——— 10.0 GHz

ULTRA WIDEBAND ANTENNA

FIELD OF THE INVENTION

The present invention relates to wideband combination antennas, and in particular to a monopole antenna surrounded by a dielectric resonator antenna to significantly increase the bandwidth of the monopole antenna.

BACKGROUND OF THE INVENTION

Monopole antennas are widely used in various applications, particularly in mobile wireless communications because they are simple to construct, compact, robust and easy to install and change when required. These properties together with the omni-directional radiation pattern make monopole antennas ideal candidates for many consumer products such as mobile phones, pagers, remote control toys, etc. In order to meet the demand of future emerging broadband wireless services, it is necessary to improve the monopole's bandwidth characteristic, while maintaining their desirable properties. Several techniques have been disclosed for monopole bandwidth enhancement. The common feature of these designs is the use of a flat monopole configuration, which affects the pattern uniformity in the horizontal plane. P. V. Anob and G. Kumar, in a paper entitled Wide-band modified triangular monopole antennas, Proc. Of the $8^{th}$ Int. Symp. On Microwave and Optical Tech., ISMOT 2001, Montreal, Canada, June 2001, pp. 169–172 disclose the use of two orthogonal flat monopoles to improve the horizontal plane pattern. However this approach results in an undesirably volumetrically large monopole.

It is known to excite a dielectric resonator antenna (DRA) using a probe sometimes referred to as a monopole. Notwithstanding, the probe is typically used solely to excite the fields within the DRA and does not act itself as a radiating element; in these instances, only the DRA is responsible for radiation. This is evident in the radiation patterns, which do not display the characteristic pattern of a monopole antenna, with a pattern null in the direction of the probe's vertical axis, but that of a DRA, which typically has a maximum in the vertical direction. A condition for which these probes do not radiate is when their physical height is significantly less than a quarter wavelength of the operating frequency. Consistent with this, the probes used to excite the DRAs are less than one eighth of a wavelength. Such an antenna is described in U.S. Pat. No. 5,940,036 in the name of Oliver et al., entitled Broadband Circularly Polarized DRA and is also described in a paper entitled General Solution of a Monopole Loaded by a Dielectric Hemisphere for Efficient Computation, K. W. Leung, IEEE Trans. AP, Vol. 48, No. 8, August 2000, pp. 1267–68. These references do not disclose a broadband monopole maintaining a desirable circulatory symmetrical configuration for a uniform horizontal coverage pattern. They disclose a DRA with a monopole probe feed having an output response of a DRA, which is different than that of the monopole.

In a paper entitled Stacked annular Ring Dielectric Resonator Antenna Excited by Axi-Symmetric Coaxial Probe, by S. M. Shum and K. M. Luk, IEEE Trans. AP Vol. 43, No. 9, August 95, pp. 889–892, two annular-ring DRAs are arranged in a vertically stacked configuration where the lower DRA is fed with a short probe and small air gaps are introduced between the two DRAs. The addition of the upper DRA improves the impedance bandwidth from 11.5% to 18%. but again the probe is less than an eighth of a wavelength and does not contribute to the radiation.

Japanese Patent Application No. 08149368 filed Nov. 6, 1996 in the names of Kawabata Kazuya et al., assigned to Murata Mfg. Co. Ltd., discloses a monopole antenna shown loaded with a plurality of dielectric layers forming a dielectric element. The dielectric element is said to cover the monopole and is shown to do so. In this configuration, the monopole antenna would be radiating, and the dielectric layers are used to assist in shaping the radiation pattern. These dielectric layers are located significantly above the ground plane and are thus not behaving as a DRA, which is typically placed right against or very near the ground plane separated from the ground plane by a small air gap. Although this invention appears to perform its intended function it does not appear to provide a monopole antenna with a significantly increased bandwidth.

The technique of coating monopole antennas with dielectric material to reduce the resonant frequency of the monopole antenna is well established. In this configuration, the presence of a dielectric coating material simply acts to load the monopole antenna in order to lower the resonant frequency. This allows for a shorter monopole to be used at a given frequency. The dielectric material itself does not radiate within the desired operating frequency range. The condition for radiation can be determined by applying the appropriate equations to determine the resonant frequency of a DRA given the relative permittivity and dimensions of the material.

U.S. Pat. No. 6,147,647, discloses a combination DRA, helix and monopole antenna for multi-band operation. The DRA exited in the HEM mode, behaves like a short horizontal magnetic dipole, which operates independently of the monopole antenna. The DRA produces circular polarized radiation, and the monopole produces linear radiation. The radiation patterns of the monopole and the DRA are also very distinct, with the DRA having maximum radiation in the broadside direction, while the monopole has a null at broadside. In this configuration, the DRA and monopole are specifically designed to minimize any electromagnetic interaction between them and can be treated as two independent antennas. The monopole and DRA have distinct feeds exciting each antenna.

Surprisingly, the antenna in accordance with this invention, provides a synergistic output response which radiates a broadband signal, being significantly broader than the composite output of a monopole and DRA alone, uncoupled.

In the configuration in accordance with this invention, the DRA and the monopole are designed to act in concert. The monopole antenna is excited with a feed, and the monopole antenna itself serves as a feed for the DRA. By exciting the DRA near its centre, the mode ($TM_{01\delta}$) generated within the DRA causes the DRA to radiate the same shape pattern as the monopole. There is a very strong interaction between the monopole and DRA. A novel feature of this invention, is that the dimensions of the monopole and the DRA are selected so that the combination of the two antennas will radiate basically the same pattern over an ultra-wide range of frequencies. The DRA is capable of operating in a $TM_{ON\delta}$ mode, where N is an integer greater than or equal to 1.

Recently, the Federal Communications Commission (FCC) has allocated 7.5 GHz of spectrum for unlicensed use of ultra-wideband devices (UWB) in the 3.1 to 10.6 GHz frequency band. The UWB spectrum will allow for low-cost, low-complexity, lower power consumption, and high-data-rate wireless connections among devices related to personal wireless communications which are carried, worn, or located near the body (such as wearable computers, a wireless desktop, or a home networking system). These devices will require compact, low-cost, low gain, ultra-wideband antennas, such as the ultra-wideband monopole-DRA in accordance with this invention.

It is an object of this invention to provide a compact broadband monopole while maintaining its desirable circulatory symmetrical configuration for a uniform horizontal coverage pattern.

SUMMARY OF THE INVENTION

In accordance with the invention, an ultra-wideband antenna for operating in a frequency band having a lowest frequency $f_1$ and a bandwidth of $B_{u\text{-}wa}$, where $B_{u\text{-}wa}$ is substantially greater than $B_m+B_{DRA}$ is provided, comprising:

a ground plane;

a DRA having a bandwidth $B_{DRA}$;

a monopole antenna having a bandwidth $B_m$ surrounded by the DRA, for feeding the DRA and for radiating energy, the monopole antenna extending beyond the DRA at an upper end, wherein the monopole antenna extends vertically above the ground plane and has an effective length L of one quarter wavelength at the lowest frequency $f_1$, wherein the DRA is for resonating at a frequency $f_{DRA}$, wherein $2\ f_1 \leqq f_{DRA} \leqq 3\ f_1$, wherein the dielectric resonator has a height H, where $H \leqq \frac{3}{4}$ L, and wherein the DRA is disposed in such a manner as being above the ground plane, and either contacting or spaced therefrom by a gap G, wherein $0 \leqq G \leqq 0.2$ H.

In accordance with another aspect of the invention, an ultra-wideband antenna for operating in a frequency band having a lowest frequency $f_1$, is provided comprising:

a ground plane;

a monopole antenna extending from the ground plane and having a effective length L of one quarter or one half wavelength, $\lambda_1/4$ or $\lambda_1/2$ respectively, at the lowest frequency $f_1$; and a dielectric resonator antenna (DRA) surrounding the monopole antenna for resonating at substantially between two and three times the lowest frequency $f_1$, the DRA having a height H less than ¾ L, the DRA being disposed in such a manner as being above the ground plane and either contacting or spaced therefrom by a gap G, wherein $0 \leqq G \leqq 0.2$ H.

BRIEF DESCRIPTION OF THE DRAWINGS

Exemplary embodiments of the invention will now be described in conjunction with the drawings in which.

DETAILED DESCRIPTION

Figure 1:
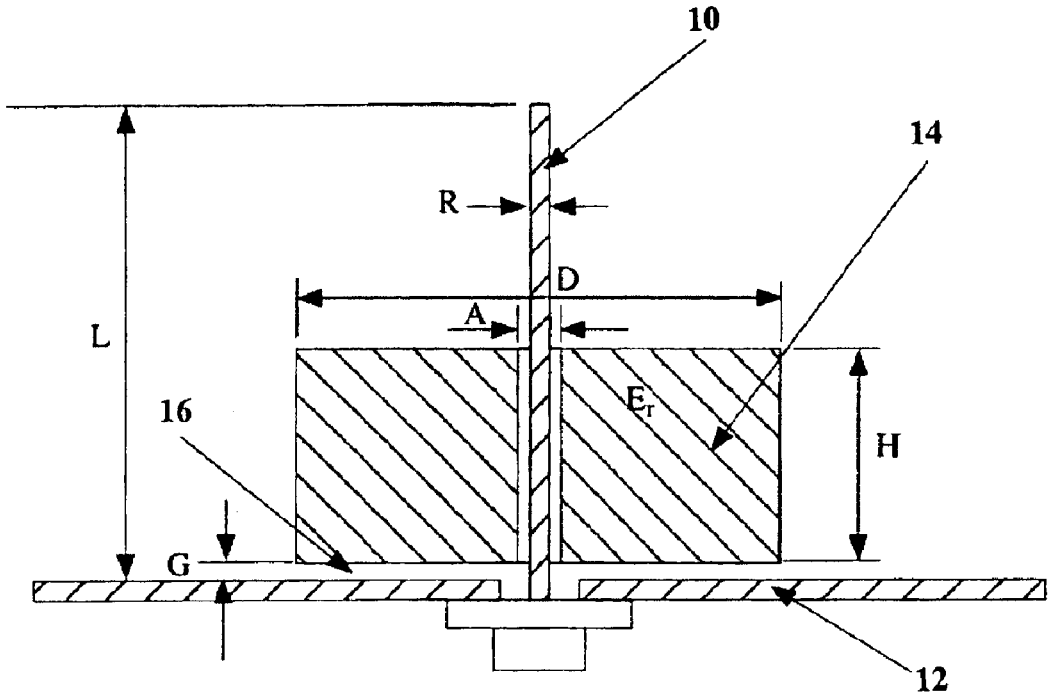
FIG. 1 is a cross-sectional view of one embodiment of the invention, showing the monopole antenna and cylindrical DRA combination.

Referring now to FIG. 1, an antenna in accordance with this invention is shown, wherein a monopole antenna 10 extends vertically in an up-right fashion from a ground plane 12. The monopole antenna 10 is a thin cylindrical wire for operating in a frequency band having a lowest wavelength $f_1$. The length L of the monopole antenna 10 is preferably one quarter wavelength at $f_1$. Hence its length L is preferably $\lambda_1/4$. Alternatively, but less preferably, it can be of length $L=\lambda_1/2$. Within this specification, it should be understood that, when referring to the length L of the monopole antenna 10, equivalence should be given for providing a monopole antenna 10 with an effective length L. For instance, one can load the monopole antenna 10 with a metal cap or dielectric coating which would obviate making the physical length a full quarter wave but would provide an effective quarter wavelength monopole antenna. A cylindrical dielectric resonator antenna (DRA) 14 is shown disposed over and surrounding the monopole antenna 10. In this embodiment the monopole antenna 10 is shown to be symmetrically disposed within the cylindrical DRA 14, however this need not be the case. The monopole antenna 10 may be offset within the DRA 14, and the DRA 14 can be asymmetrical. Preferable, the DRA 14 is located a small air gap 16 distance from the ground plane 12. In this embodiment the DRA 14 is constructed from a dielectric material having a dielectric constant $\epsilon_r$ greater than 8, and preferably greater than 10. The higher $\epsilon_r$, however can affect the achievable bandwidth enhancement. The DRA 14 is designed to operate in the $TM_{01\delta}$ mode which has a circularly symmetric modal field pattern with maximum electric field along the axis of the cylindrical DRA. This maximum electric field coincides with the electric current flowing along the monopole, allowing the centrally located monopole antenna 10 to efficiently excite the required $TM_{01\delta}$ mode, since it is well known from coupling theory that an efficient transfer of energy occurs when the electric current of the feed, in this instance the monopole is located in the vicinity of the maximum electric fields of the antenna, in this case the DRA.

In operation, the monopole antenna 10 simultaneously performs two functions, as a radiator and as the only feed for the DRA 14, thus eliminating the requirement for a separate feed for the DRA.

The broadband DRA-loaded monopole in accordance with this invention, can be considered as two cascaded resonating circuits, which resonate at two different frequencies. The circuit parameters depend on the monopole antenna 10, the DRA 14 and the air gap 16. The selection of these parameters greatly affects the operation of this antenna to achieve a much wider bandwidth than that of the monopole antenna 10, alone, in combination with the DRA 14, alone. The benefit is achieved by the interaction of these two radiators after careful selection of the parameters is made, that is, selecting appropriate dimensions, placement, and a suitable dielectric constant for the DRA material.

Figure 2:
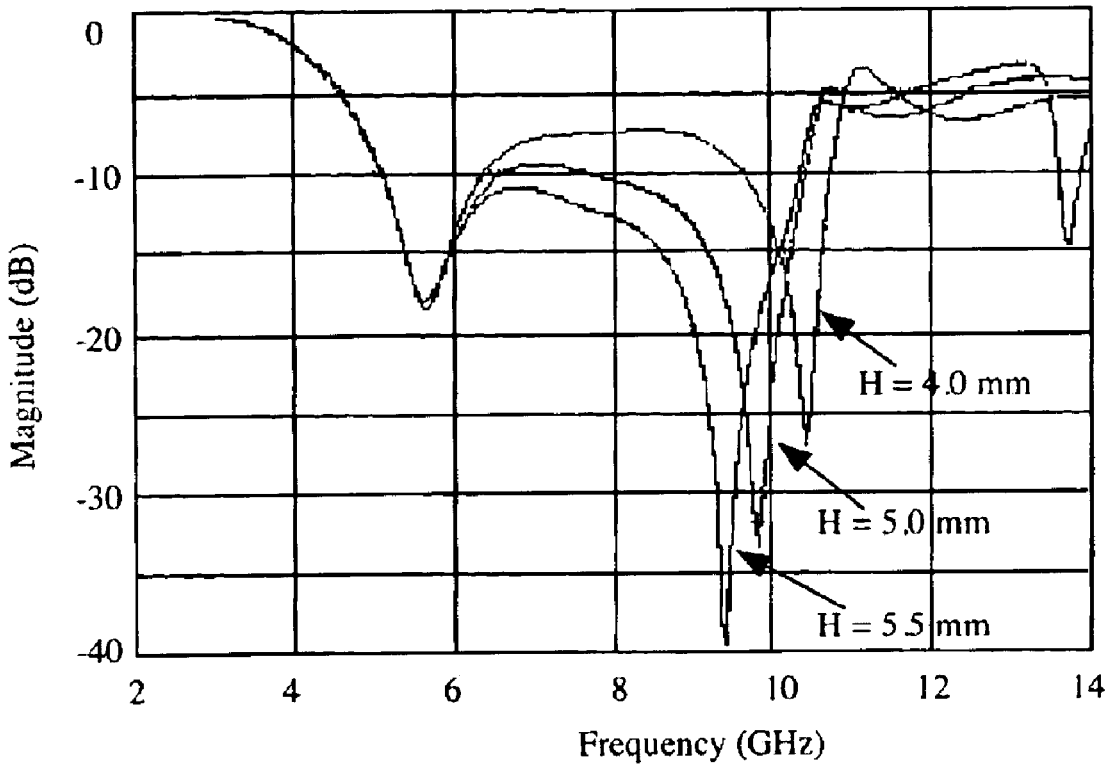
FIG. 2 is a graph showing the return loss of a monopole-DRA antenna for three different heights H of the DRA.

The monopole antenna 10 is designed to operate at the lower band edge of the wavelength band of operation, where it accounts for most of the radiation. As the frequency increases most of the radiation will come from the DRA 14. In the design the two resonating frequencies are chosen so that the cross over point satisfies the matching requirement. As an example, a monopole-DRA is to be designed to operate within the 5–10 GHz frequency band. FIG. 2, shows the return loss of the monopole-DRA antenna for three different heights H of the DRA. In this case, the monopole antenna is designed to resonate at approximately 5.5 GHz, as seen by the dip in the return loss curve. The three DRAs of height H=4 mm, 5 mm, and 5.5 mm, are designed to resonate at frequencies of 10.5 GHz, 9.8 GHz, and 9.3 GHz, respectively, which can again be seen as dips in the return loss curves in FIG. 2. For an antenna, a return loss of less than −10 dB is considered acceptable for efficient radiation. When the DRA of H=4 mm is used, it is seen that there is a wide range of frequencies (from approximately 6.5 to 9.5 GHz, where the return loss curve is worse (greater) than −10 dB. In this region, the antenna would not radiate efficiently. By increase the DRA height H (thus lowering the resonant frequency), the return loss in the intermediate frequencies (between the resonant frequency of the isolated monopole and the DRA) is seen to improve. By using the DRA with H=5.5 mm, the return loss is better than −10 dB over the entire band from approximately 5.0 GHz to 10.2 GHz. Thus this example demonstrates how the resonant frequency of the DRA has been adjusted to obtain a wideband performance of the combined monopole-DRA antenna.

The design procedure for achieving a broadband performance can be summarized as follows:

1) The monopole 10 length is chosen so that it operates as a quarter-wave monopole at the lower band edge. 2) The DRA 14 dimensions are designed to resonate at the higher band edge. As an example, the resonant frequency $f_{DRA}$ for the $TM_{01\delta}$ mode of the cylindrical resonator shown in FIG. 1 can be estimated using the known formula:

$$f_{DRA} = \frac{c}{2\pi D\sqrt{E_r}}\sqrt{x_o^2 + \left(\frac{\pi D}{2H}\right)^2}$$

where c is the speed of light in a vacuum and $x_0$ is the solution to $$\frac{J_1(x_o)}{Y_1(x_o)} = \frac{J_1\left(\frac{D}{A}x_o\right)}{Y_1\left(\frac{D}{A}x_o\right)}$$

where $J_1$ and $Y_1$ are Bessel functions of the first and second kind, respectively.

2) DRA 14 parameters including diameter (D) height (H), relative permittivity $E_r$ and the air gap G are modified for the bandwidth enhancement optimization.

Figure 3:
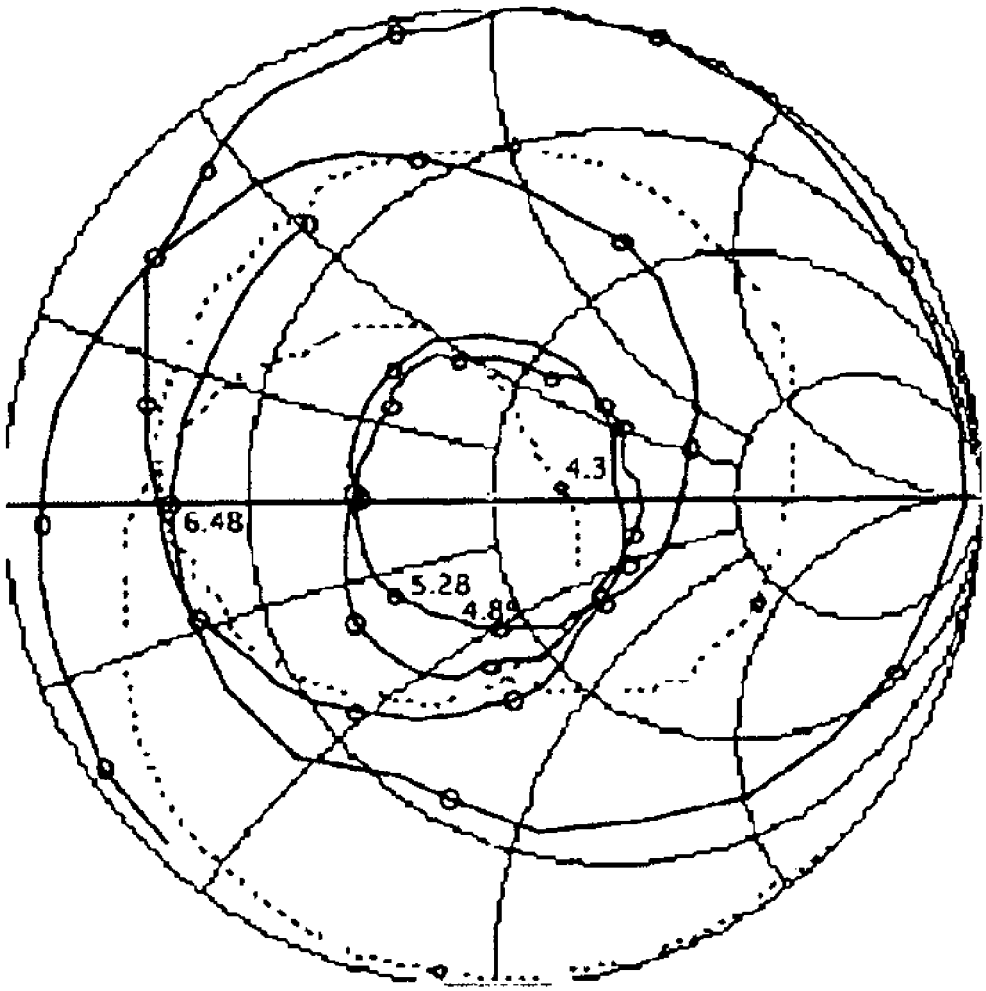
FIG. 3 is a Smith chart graph showing the input impedance of the monopole alone and the monopole-DRA antenna.
Figure 4:
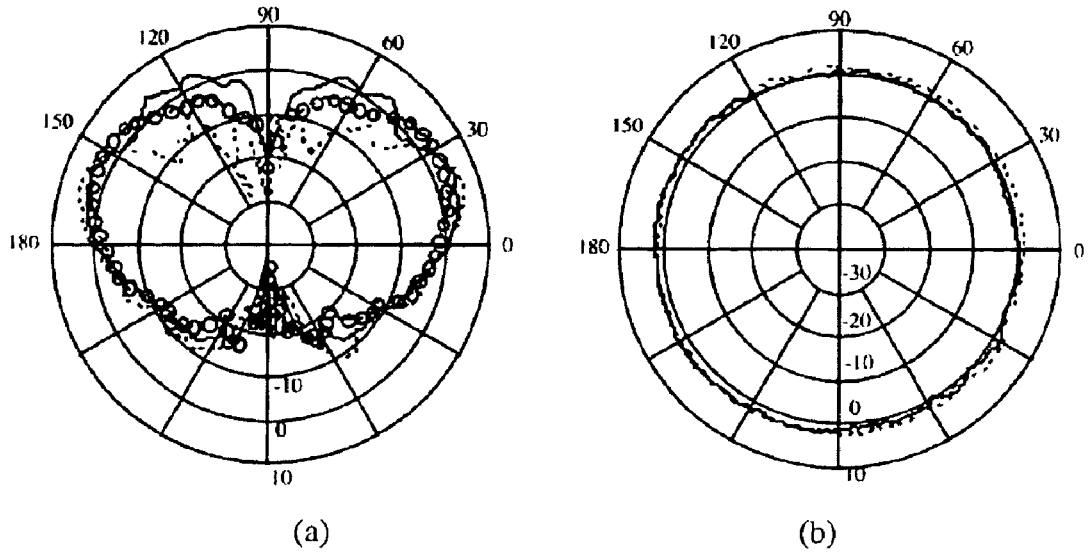
FIG. 4 shows the measured radiation patterns of a monopole-DRA antenna.

Referring now to FIG. 3 input impedances are shown for a no-load monopole antenna and a DRA-loaded monopole antenna. It is evident that the DRA-loaded monopole in accordance with the teachings of this invention illustrates a broadband characteristic. The DRA-loaded case shows double resonating impedance loops, which verify the concept of two cascaded resonant circuits describable by an equivalent circuit of two parallel RLC networks connected in series. The effects of DRA loading can be observed from a contraction of the original monopole impedance loop, which continues into the second loop due to the DRA radiation. It is clear that the quality factor of the original monopole is decreased by the additional radiation from the DRA $TM_{01\delta}$ mode. The operating frequency range of the no-load monopole is from 3.8 to 4.6 GHz for a voltage standing wave ratio (VSWR)<2. The same monopole with DRA loading results in an operating frequency range of 4.3 to 10.2 GHz, representing a bandwidth ration of 1:2.37. It is also observed that the lower band edge is slightly increased from 3.8 to 4.3 GHz. The radiation patterns in the vertical plane of the DRA-loaded monopole remain unchanged over the operating frequency band as shown in FIG. 4. The patterns in the horizontal plane are remarkably omnidirectional with a variation of less than 3 dB as expected from a monopole and $TM_{01\delta}$ mode DRA. The cross polarization component in the azimuth plane is always better than 18 dB over the band.

Numerous other embodiments may be envisaged without departing from the sprit and scope of this invention.

What is claimed is:

1. An ultra-wideband antenna for operating in a frequency band having a lowest frequency $f_1$, comprising:

a ground plane;

a monopole antenna extending from the ground plane and having an effective length L of one quarter or one half wavelength, $\lambda_1/4$ or $\lambda_1/2$ respectively, at the lowest frequency $f_1$; and a dielectric resonator antenna (DRA) surrounding the monopole antenna for resonating at substantially between or at two and three times the lowest frequency $f_1$, the DRA having a height H less than ¾ L, the DRA being disposed in such a manner as being above the ground plane and either contacting or spaced therefrom by a gap G, wherein $0 \leqq G \leqq 0.2$ H.

2. The ultra-wideband antenna as defined in claim 1, wherein $H \leqq L/2$; and wherein the monopole antenna extends beyond the dielectric antenna at an upper free end thereof, the upper end of the monopole antenna for generating a monopole radiation pattern.

3. The ultra-wideband antenna as defined in claim 2, wherein the relative permittivity Er of material comprising the DRA is equal to or greater than 8.

4. An ultra-wideband antenna for operating in a frequency band having a lowest frequency $f_1$ and a bandwidth of $B_{u\text{-}wa}$, where $B_{u\text{-}wa}$ is at least 4-times greater than $B_m + B_{DRA}$, comprising:

a ground plane;

a dielectric resonator antenna (DRA) having a bandwidth $B_{DRA}$;

a monopole antenna having a bandwidth $B_m$ surrounded by the DRA, for feeding the DRA and for radiating energy, the monopole antenna extending beyond the DRA at an upper end, wherein the monopole antenna extends vertically above the ground plane and has an effective length L of one quarter wavelength at the lowest frequency $f_1$, wherein the DRA is for resonating at a frequency $f_{DRA}$, wherein $2 f_1 \leqq f_{DRA} \leqq 3 f_1$, wherein the antenna is of a height H, where $H \leqq ½ L$, and wherein the DRA is disposed in such a manner as being above the ground plane, and either contacting or spaced therefrom by a gap G, wherein $0 \leqq G \leqq 0.2$ H.

5. An ultra-wideband antenna as defined in claim 4, wherein the DRA is for operating primarily in a $TM_{0N\delta}$ mode, where N is an integer greater than or equal to 1.

6. An ultra-wideband antenna as defined in claim 4, wherein the monopole antenna provides only a single feed to the DRA.

7. An ultra-wideband antenna as defined in claim 1, wherein the monopole antenna provides only a single feed to the DRA.

8. An ultra-wideband antenna as defined in claim 4, wherein the DRA is for operating primarily in a $TM_{01\delta}$ mode.

9. An ultra-wideband antenna for operating in a frequency band having a lowest frequency $f_1$ approximately 3.3 GHz, comprising a ground plane;

a monopole antenna extending from the ground plane and having an effective length L of approximately one quarter the wavelength at frequency $f_1$; and a dielectric resonator antenna (DRA) surrounding the monopole antenna for resonating in a $TM_{01\delta}$ mode at approximately three times the lowest frequency $f_1$, the DRA having a height H between 0.3 L and 0.5 L, having a relative dielectric constant $E_r$ of approximately 10, the DRA being disposed in such a manner as being above the ground plane and either contacting or spaced therefrom by a gap G, wherein G is less than or equal to 0.2 H.

* * * * *